US005369986A

United States Patent [19]

Koch

[11] Patent Number: 5,369,986

[45] Date of Patent: Dec. 6, 1994

[54] SEALING ELEMENT FOR USE IN CIGARETTE TESTING APPARATUS

[75] Inventor: Franz-Peter Koch, Schwarzenbek, Germany

[73] Assignee: Körber AG, Hamburg, Germany

[21] Appl. No.: 160,494

[22] Filed: Dec. 1, 1993

[30] Foreign Application Priority Data

Dec. 11, 1992 [DE] Germany ..... 4241796

[51] Int. Cl.[5] ..... G01M 3/04; G01M 3/26; G01N 15/08

[52] U.S. Cl. ..... 73/49.8; 131/904; 131/906; 73/37; 73/38

[58] Field of Search ..... 131/904, 906; 73/49.8, 73/37, 38

[56] References Cited

U.S. PATENT DOCUMENTS

| | | | |
|---|---|---|---|
| 3,237,444 | 3/1966 | Kaeding et al. | 73/45.1 |
| 3,339,402 | 9/1967 | Rudszinat | 73/41 |
| 3,386,281 | 6/1968 | Menge et al. | 73/41 |
| 3,769,832 | 11/1973 | Baier | 73/41 |
| 3,948,084 | 4/1976 | Heitmann et al. | 73/41 |
| 3,962,906 | 6/1976 | Heitmann et al. | 73/41 |
| 4,171,635 | 10/1979 | Calleson et al. | 73/38 |
| 4,429,567 | 2/1984 | Koch et al. | 73/49.8 |
| 4,528,841 | 7/1985 | Siems | 73/38 |
| 4,630,466 | 12/1986 | Berlin | 73/38 |
| 4,888,977 | 12/1989 | Chehab et al. | 73/38 |

FOREIGN PATENT DOCUMENTS

| | | |
|---|---|---|
| 3534453 | 4/1987 | Germany . |
| 2183136 | 9/1989 | United Kingdom . |

*Primary Examiner*—Hezron E. Williams
*Assistant Examiner*—J. David Wiggins
*Attorney, Agent, or Firm*—Darby & Darby

[57] ABSTRACT

A sealing element for the end portions of cigarettes or other rod-shaped articles of the tobacco processing industry has an elastic tubular body defining a longitudinally extending passage for the flow of air or another testing fluid from one end of an article being tested or in the opposite direction. The end face of the article being tested is engaged by a deformable membrane at one end of the passage, and such membrane has a central opening for the flow of testing fluid from or into an enlarged chamber between the membrane and an internal fluid deflecting baffle of the tubular body. The baffle causes the testing fluid to flow in the chamber radially inwardly toward or radially outwardly from the opening in the membrane and thus prevents the accumulation of tobacco particles and/or particles of filter material for tobacco smoke in the chamber. The stream of testing fluid in the major portion of the passage flows in the axial direction of the article being tested. The radial component or components of the flow of testing fluid reduce the likelihood of clogging of the chamber and/or other parts of the passage with solid particles.

12 Claims, 1 Drawing Sheet

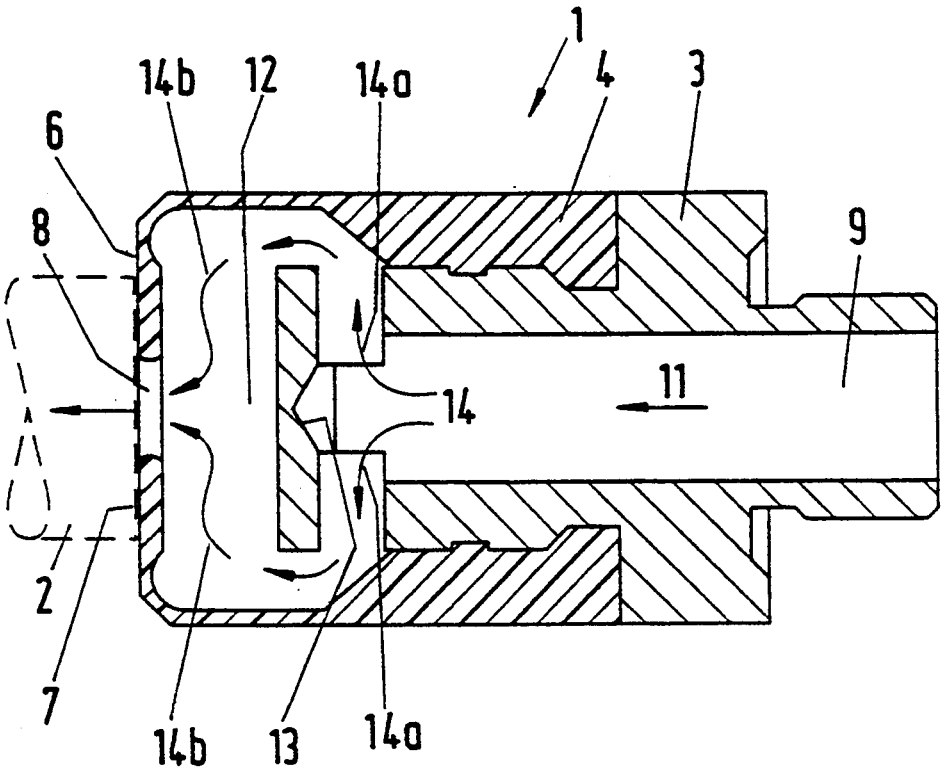
1
14b
12
14a
4
3
6
8
9
11
14
2
7
14b
13
14a

SEALING ELEMENT FOR USE IN CIGARETTE TESTING APPARATUS

BACKGROUND OF THE INVENTION

The invention relates to sealing elements in general, and more particularly to improvements in sealing elements of the type often utilized in apparatus for testing plain or filter cigarettes or other rod-shaped articles of the tobacco processing industry with a fluid medium. Apparatus which can utilize sealing elements of the present invention are disclosed, for example, in U.S. Pat. No. 3,948,084 granted Apr. 6, 1976 to Heitmann et al. The disclosure of this patent is incorporated herein by reference.

Successive rod-shaped articles of the tobacco processing industry are normally tested with a fluid, such as air, which is admitted (e.g., drawn) through one end of a rod-shaped article (hereinafter called cigarette for short) and is evacuated through the other end or escapes through one or more holes in the tubular wrapper, through an open seam of the wrapper, at the frayed ends of the wrapper and/or through an overly porous wrapper of a defective article. Uncontrolled escape of testing fluid from the path between the two ends of a cigarette is detected by suitable monitoring means having means for generating signals which are used to segregate defective articles from satisfactory articles and/or to carry out adjustments which are necessary to cease the making of defective articles.

Heretofore known sealing elements which are utilized in cigarette testing apparatus (e.g., in apparatus of the type disclosed in the patent to Heitmann et al.) are normally made of an elastomeric material and resemble or constitute tubular bodies with readily deformable apertured end walls which are moved into abutment with end faces of cigarettes to be tested preparatory to causing a testing fluid to flow from a sealing element into the adjacent end portion of a cigarette or in the opposite direction.

A drawback of presently known sealing elements is that they are likely to gather fragments of tobacco and/or filter material for tobacco smoke. The thus gathered particles can interfere with the flow of testing fluid so that a defective cigarette is likely to be classified as a satisfactory product or that a satisfactory cigarette is segregated from other satisfactory cigarettes because the testing of the satisfactory cigarette resulted in the generation of signals denoting defective cigarettes.

OBJECTS OF THE INVENTION

An object of the invention is to provide a novel and improved sealing element which can be utilized as a superior substitute for heretofore known and used sealing elements in testing apparatus for plain or filter cigarettes, cigars, cigarillos or cheroots of unit length or multiple unit length and/or for the testing of sections of rod-shaped filters for tobacco smoke.

Another object of the invention is to provide a sealing element which is less likely to gather fragments of tobacco and/or filter material for tobacco smoke than heretofore known sealing elements.

A further object of the invention is to provide a sealing element which can be mass produced at a low cost and which can be put to use in existing machines or apparatus for testing cigarettes and/or other rod-shaped articles of the tobacco processing industry.

An additional object of the invention is to provide a testing apparatus which employs sealing elements of the above outlined character.

Still another object of the invention is to provide a novel and improved method of preventing the accumulation of fragments of tobacco or other particulate material in a sealing element for a testing fluid, such as air.

A further object of the invention is to provide a novel and improved method of guiding testing fluid at the ends of successive cigarettes or other rod-shaped articles of the tobacco processing industry.

Another object of the invention is to provide a sealing element which is devoid of pronounced dead corners or other configurations likely to entrap fragments of solid material and to thus influence the flow of a fluid through the sealing element.

An additional object of the invention is to provide a sealing element which can stand longer periods of uninterrupted use than heretofore known sealing elements.

Still another object of the invention is to provide the sealing element with novel and improved means for preventing partial or complete plugging of the passage for the flow of a testing fluid into or from an end portion of a rod-shaped article of the tobacco processing industry.

SUMMARY OF THE INVENTION

The invention is embodied in a sealing element for a testing fluid which passes through rod-shaped articles (such as plain or filter cigarettes) of the tobacco processing industry. The improved sealing element comprises a tubular body including (a) an end wall having an external surface which is engageable with an end portion of an article to be tested, and (b) at least one fluid-transmitting opening in the end wall. The tubular body defines a fluid conveying passage having an end in communication with the at least one opening and such passage defines a path for the flow of testing fluid. In accordance with a feature of the invention, the path is configurated in such a way that it establishes for the testing fluid at least one component of flow substantially radially of the tubular body.

At least the end wall of the tubular body preferably contains an elastomeric material, e.g., a material selected from the group consisting of rubber and elastomers (such as silicone rubber).

The tubular body can be provided with a substantially cylindrical outer surface, and the aforementioned passage can include at least one portion for the flow of testing fluid substantially axially of the outer surface and at least one portion for the flow of testing fluid substantially radially of the outer surface.

The tubular body can further comprise an internal fluid deflecting portion which is adjacent the at least one substantially radially extending component of flow of testing fluid in the passage. The deflecting portion can include a baffle which extends transversely of a substantially axially extending portion of the passage in the tubular body.

The at least one opening in the end wall can constitute a fluid-admitting inlet or a fluid-discharging outlet of the passage.

The at least one substantially radially extending component of fluid flow in the passage is or can be adjacent the end wall of the tubular body.

The end wall can constitute or include a deformable membrane having a single substantially centrally located opening.

The novel features which are considered as characteristic of the invention are set forth in particular in the appended claims. The improved sealing element itself, however, both as to its construction and the mode of using the same, together with additional features and advantages thereof, will be best understood upon perusal of the following detailed description of certain presently preferred specific embodiments with reference to the accompanying drawing.

BRIEF DESCRIPTION OF THE DRAWING

The single FIGURE of the drawing is a central longitudinal sectional view of a sealing element which embodies one form of the invention, a portion of a rod-shaped smokers' article being indicated by broken lines adjacent the end wall of the tubular body of the sealing element.

DESCRIPTION OF PREFERRED EMBODIMENTS

The drawing illustrates a sealing element comprising an elongated tubular body 1 of elastomeric material, such as natural rubber or an elastomer (e.g., silicone rubber). The sealing element which is shown in the drawing is drawn to a greatly enlarged scale. The purpose of the tubular body 1 is to convey a flow of testing fluid 14 (e.g., air, such as compressed air) into one end portion of a rod-shaped article 2 of the tobacco processing industry or in the opposite direction. The article 2 is assumed to constitute a plain or filter cigarette and is to be tested for the integrity of its wrapper, for the integrity of the longitudinally extending seam, for the permeability of the wrapper and/or for other purposes. The end face of the illustrated end portion of the article 2 (hereinafter called cigarette) is adjacent the plane or substantially plane external surface 6 of a membrane-like deformable end wall 7 of the tubular body 1. The other end of the tubular body 1 is slipped onto and sealingly engages a nipple forming part of a metallic support 3 serving to facilitate installation of the body 1 in a testing apparatus, such as the apparatus disclosed in the aforementioned U.S. Pat. No. 3,948,084 to Heitmann et al. The metallic support 3 which is shown in the drawing is an elongated tube having an axial passage 9 for a flow of testing fluid 14 in the direction of arrows 11, 14*a* and 14*b*, i.e., toward and into the illustrated end portion of the cigarette 2. At least the left-hand portion of the support 3 (this support can also be made of a plastic material) can be said to form part of the improved sealing element, and the passage 11 extends axially of the cylindrical outer surface 4 of the tubular body 1. Successive increments of testing fluid 14 leave the passage 11 through a central fluid transmitting opening 8 which is provided in the end portion, or membrane, 7 and discharges testing fluid into the adjacent end face of the cigarette 2. At such time, the end face of the cigarette 2 is sealingly engaged by the external surface 6 of the end wall 7 to prevent uncontrolled escape of testing fluid 14 between the cigarette 2 and the tubular body 1, i.e., radially outwardly along the adjacent edge portion of the tubular wrapper of the cigarette 2.

If the testing fluid 14 is a compressed gaseous fluid, it is caused to flow in the direction of arrows 11, 14*a* and 14*b* on its way into the cigarette 2 by way of the opening 8 in the end wall 7. The testing fluid 14 escapes through the other end portion (not shown) of the cigarette 2 if the latter is satisfactory. If the wrapper of the cigarette 2 is defective, the pressure of testing fluid 14 issuing at the left-hand end of the cigarette 2 is too low; this is detected by a suitable monitoring device which generates a signal to identify and permit ejection of a defective cigarette and/or to initiate an adjustment in order to eliminate the cause of defect or defects.

That portion of the passage 9 in the tubular body 1 and the support 3 which is adjacent the internal surface of the end portion 7 constitutes a chamber 12 which communicates with the opening 8 and receives testing fluid having a component extending radially inwardly of the tubular body 1 and its cylindrical outer surface 4 (see the arrows 14*b*). The chamber 12 is disposed between the end wall 7 and a substantially radially extending internal fluid deflecting portion or baffle 13. The dimensions of the baffle 13 are selected in such a way that the flow of testing fluid 14 in the passage 9 of the body portion 1 and support 3 has a radially outwardly directed component (arrows 14*a*) upstream of the baffle 13 and a radially inwardly directed component (arrows 14*b*) downstream of the baffle, namely in the chamber 12. The just described mode of guiding testing fluid 14 from the inlet at the right-hand end of the passage 9 to the outlet (such outlet is constituted by the opening 8) reduces the likelihood of accumulation, and at least substantially prevents the accumulation, of fragments of tobacco particles and/or particles of filter material in the chamber 12. Such particles could interfere with the flow of testing fluid 14 into the end portion of a cigarette 2 and could cause the apparatus to furnish inaccurate test results. Thus, defective cigarettes could be transferred to a packing machine and/or satisfactory cigarettes could be ejected together with defective cigarettes downstream of the testing station. It has been found that the establishment of a path wherein the testing fluid 14 must flow with at least one component at least substantially radially of the tubular body 1 (as at 14*a* and/or 14*b*) greatly reduces the likelihood of partial or pronounced clogging or plugging of the passage 9. This ensures more accurate testing of cigarettes 2 and renders it possible to operate the testing apparatus for longer intervals of time without inspection and/or frequent replacement of sealing elements.

The surface bounding the chamber 12 is or can be configurated to promote the flow of (once or more than once) deflected testing fluid 14 from the axially extending rear portion of the passage 9 toward and into the chamber 12 and thence through the opening 8 and into the adjacent end portion of the cigarette 2 at the testing station. Thus, even though the radially outer portion of the chamber 12 cannot readily provide dead corners for entrapment and retention of fragments of tobacco particles and/or filter material, the likelihood of the establishment of such dead corners can be further reduced by appropriate shaping of the surface surrounding the chamber 12.

An additional advantage of the improved sealing element is that the radially inwardly directed component of the flow of testing fluid 14 (as at 14*b*) entails the development of at least some or even pronounced turbulence in the chamber 12 which is even more conducive to prevention of gathering of fragments of tobacco and/or filter material in any part of the passage 9. It has been found that the sealing element of the present invention reduces the likelihood of clogging of the passage 9 in its tubular body 1 and/or support 3 regardless of whether the testing fluid 14 flows in the directions as indicated by the arrows 11, 14*a* and 14*b* (i.e., so that the opening 8 constitutes an outlet for testing fluid) or in the opposite direction (i.e., when the opening 8 constitutes an inlet for admission of testing fluid from a cigarette 2 into the tubular body 1).

The testing fluid 14 forming the stream or flow in the passage 9 can be admitted into the passage at an elevated pressure (e.g., by maintaining a subatmospheric pressure at the right-hand end of the passage 9 in the support 3 and tubular body 1) or such flow can be maintained at an elevated pressure so that the chamber 12 constitutes a plenum chamber. It is also possible to establish subatmospheric pressure around the wrapper of the cigarette 2 so that testing fluid is drawn axially into the right-hand end and radially outwardly through one or more holes or other defective portions of the wrapper. Alternatively the pressure around the wrapper can be maintained above atmospheric pressure so that atmospheric air is forced into the cigarette radially inwardly to flow through one or more defective portions of the wrapper and thereupon axially into the chamber 12. The pressure of air is monitored and the monitoring means generates signals denoting detection of satisfactory or defective cigarettes.

The entire tubular body 1 of the improved sealing element need not be made of an elastomeric material. For example, it often suffices if only the end wall or membrane 7 of the tubular body 1 is made of rubber or the like so that its external surface 6 can sealingly engage the adjacent end face of a cigarette 2.

An important advantage of the improved sealing element is that it can be utilized as a superior substitute for heretofore known sealing elements which are more likely to be clogged with particles of tobacco and/or other solid material. The likelihood that any particles which happen to enter the passage 9 would come to a halt anywhere between the opening 8 and the other end of the passage is o greatly reduced, irrespective of the direction of flow of testing fluid 14, by the simple expedient of establishing for the flow of testing fluid in the passage 9 at least one radial component toward or away from the cylindrical outer surface 4 of the tubular body 1. This ensures that the flowing testing fluid 14 entrains solid particles from the passage 9. Moreover, it is possible to reduce the cross-sectional area of the passage 9 so that the solid particles are even less likely to come to a halt at the sheltered side of the flow.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A sealing element for a testing fluid passing through rod-shaped articles of the tobacco processing industry, comprising a tubular body including an end wall having an external surface engageable with an end face of an article to be tested and at least one fluid-transmitting opening provided in said end wall and confronting the end face of the article which engages said external surface, said body further having a fluid conveying passage having an end in communication with said at least one opening and defining a path for the flow of testing fluid, said path being configurated to establish for the testing fluid at least one component of flow substantially radially of the tubular body.

2. The sealing element of claim 1, wherein at least said end wall contains an elastomeric material.

3. The sealing element of claim 2, wherein said elastomeric material is selected from the group consisting of rubber and elastomers.

4. The sealing element of claim 1, wherein said tubular body has a substantially cylindrical outer surface and said passage includes at least one portion for the flow of testing fluid substantially axially of said outer surface and at least one portion for the flow of testing fluid substantially radially of said outer surface.

5. The sealing element of claim 1, wherein said tubular body further comprises an internal fluid deflecting portion adjacent the at least one substantially radial component of flow of testing fluid in said passage.

6. The sealing element of claim 5, wherein said deflecting portion includes a baffle extending transversely of a substantially axially extending portion of said passage in said tubular body.

7. The sealing element of claim 1, wherein said at least one opening is a fluid-admitting inlet of said passage.

8. The sealing element of claim 1, wherein said at least one opening is a fluid-discharging outlet of said passage.

9. The sealing element of claim 1, wherein the at least one substantially radially extending component of fluid flow in said passage is adjacent said end wall.

10. The sealing element of claim 1, wherein said end wall is a deformable membrane having a single substantially centrally located opening.

11. A sealing element for a testing fluid passing through rod-shaped articles of the tobacco processing industry, comprising a tubular body including an end wall having an external surface engageable with an end portion of an article to be tested and at least one fluid-transmitting opening in said end wall, said body further having a fluid conveying passage having an end in communication with said at least one opening and defining a path for the flow of testing fluid, said path being configurated to establish for the testing fluid at least one component of flow substantially radially of the tubular body, said body further comprising an internal fluid deflecting portion adjacent the at least one substantially radial component of flow of testing fluid in said passage.

12. The sealing element of claim 11, wherein said deflecting portion includes a baffle extending transversely of a substantially axially extending portion of said passage in said body.

* * * * *